United States Patent [19]

Snow et al.

[11] 3,993,860

[45] Nov. 23, 1976

[54] ELECTRICAL CABLE ADAPTED FOR USE ON A TRACTOR TRAILER

[75] Inventors: John P. Snow, Sagamore Hills; James J. Callahan, Mentor, both of Ohio

[73] Assignee: Samuel Moore and Company, Aurora, Ohio

[22] Filed: Aug. 18, 1975

[21] Appl. No.: 605,389

[52] U.S. Cl. ..... 174/69; 174/115; 174/116

[51] Int. Cl.[2] ..... H01B 7/06

[58] Field of Search ..... 174/115, 116, 69

[56] References Cited

UNITED STATES PATENTS

| | | | |
|---|---|---|---|
| 3,517,110 | 6/1970 | Morgan | 174/116 X |
| 3,829,603 | 8/1974 | Hansen | 174/115 |

*Primary Examiner*—E. A. Goldberg
*Attorney, Agent, or Firm*—Clelle W. Upchurch

[57] ABSTRACT

An electrical cable of conventional or retractable helical coil form which is relatively small in diameter and sufficiently flexible to be used to advantage on a tractor-trailer to connect the power supply on the tractor with the electrical system carried by the trailer has a polymeric sheath, an insulated 10 gauge stranded conductor substantially coaxial with the sheath, four to six insulated stranded 12 gauge conductors substantially evenly spaced about the periphery of the 10 gauge conductor, a plurality of uninsulated stranded conductors of 14 gauge disposed between the smaller insulated conductors, filler material filling the spaces between the conductors and preferably a plastic film helically wound about the conductors. The 12 and 14 gauge conductors are helically wound about the 10 gauge conductor. The assembly of conductors, filler and plastic film combine to form a cable having a substantially circular cross-section and substantially fill the sheath. The cable is preferably coiled into a self-storing configuration.

10 Claims, 3 Drawing Figures

2
2
10
11
12
13
14
15
16
17

10
11
12
13
14
15
16
17

12
18
19
20

ELECTRICAL CABLE ADAPTED FOR USE ON A TRACTOR TRAILER

This invention relates generally to electrical cable and more particularly to an electrical cable which can be used to advantage to connect a power source carried by the tractor of a tractor-trailer rig to the electrical system of the trailer or trailers where the rig includes more than one trailer.

The electrical cable used between the power system of the tractor of a tractor-trailer rig to the wiring on the trailer for exterior lamps, anti-skid devices, refrigerators and the like requires several different wires cabled together and enclosed in a protective jacket or sheath. This cable must be durable, flexible, resistant to road splash, stones, grease, oil and abrasion. Moreover, it is desirable that the cable be adaptable to accommodate trailers which have an adjustable length without the possibility of the cable dragging on the road and being abraded. The cable design preferably follows the recommendations of various state and federal highway departments and other regulating bodys. The heretofore commercially available cables of equivalent circular mil area for this purpose have had a relatively large diameter and are relatively heavy and cumbersome. The cables have a plurality of insulated wires grouped together in a protective sheath. In some instances, the cables have been made self-retractable.

It is an object of this invention to provide an improved cable adapted to be used to advantage in connecting the power source of a tractor to the electrical system of a trailer of a tractor-trailer rig. Another object of the invention is to provide a cable useful in tractor-trailer rigs which is of relatively small diameter and flexible and thus more easily installed than heretofore available commerical cables. A more specific object of the invention is to provide a flexible, self-storing cable with controlled extensibility-contractibility characteristics having a plurality of insulated conductors adapted to be used to connect a power source of a tractor to the electrical system of trailers of a tractor-trailer rig.

Other objects will become apparent from the following description with reference to the accompanying drawing wherein FIG. 1 is a cutaway side elevation of a length of cable provided as one embodiment of this invention;

Figure 1:
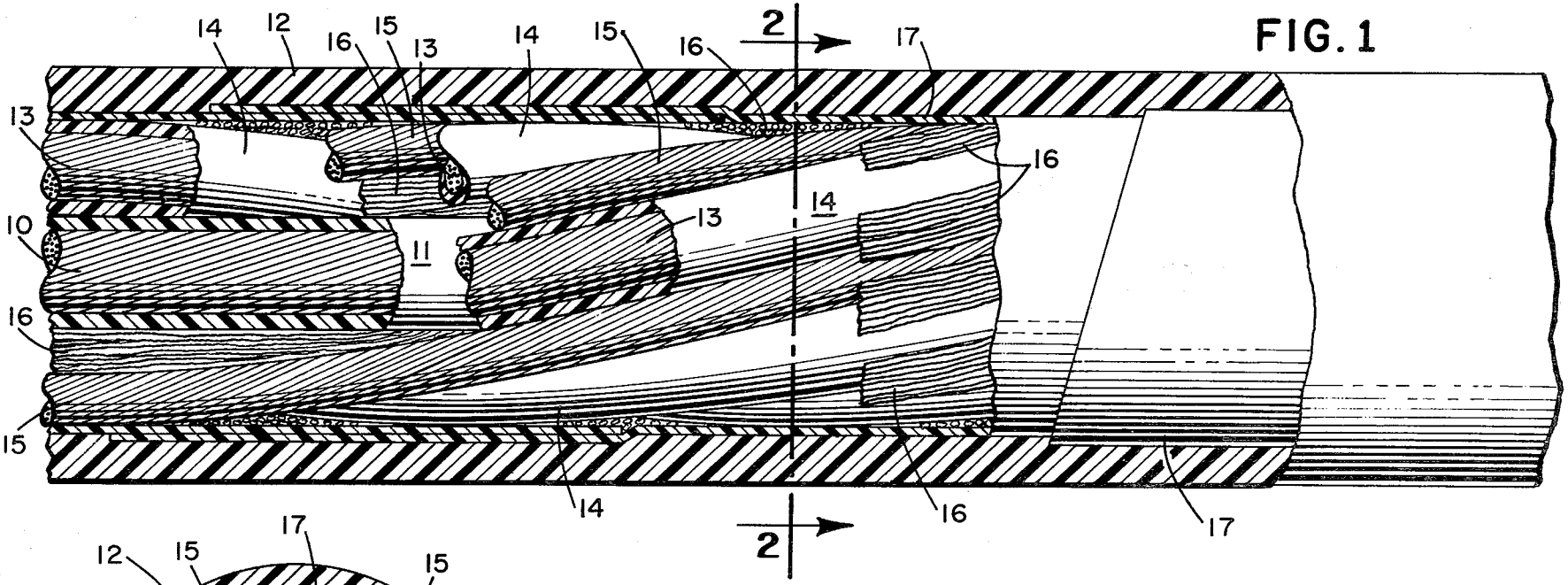

The foregoing objects and others are accomplished in accordance with this invention, generally speaking, by providing a cable having a particular combination of wire gauge, number of wires and wire placement within an extruded polymeric protective sheath disposed in a substantially circular cross-section. It is preferred that the cable have a retractable coiled configuration so that it is self-storing. The cable has a single electrically insulated 10 gauge stranded wire centrally disposed in the sheath and extending longitudinally therethrough, four to six but preferably five electrically insulated 12 gauge stranded wires substantially evenly circumferentially spaced about the 10 gauge wire and within the sheath, and a plurality, preferably five, stranded 14 gauge wires, preferably uninsulated and disposed in the spaces between the circumference of the 12 gauge insulated wires and the sheath. The spaces between the various components may be filled with cotton twine or other suitable filler material. The assembly of 12 and 14 gauge wires are cabled together about the 10 gauge wire and a plastic film may be wrapped helically with its edges overlapping about the assembly of wires. The uninsulated ground wires are grouped together at the end of the cable to form a common conductor with a circular mil area equal to or greater than an 8 gauge wire. A polymeric sheath is extruded directly over the film. It has been found that a cable having this particular structure combining the particular number of wires of the specified gauge can be used to advantage to connect the power source on a tractor with the electrical system on a trailer of a tractor-trailer rig. The wire may be shaped into a permanent retractable form by heating it while wound about a suitable mandrel to between its softening and melting point and quenching it while wound about the mandrel.

The 10 and 12 gauge conductors may be insulated with a coating of "Hytrel" segmented copolyester. This primary wire insulation may also be an extruded layer of a blend of "Hytrel" plus polyvinyl chloride polymer, "Hytrel" plus an aromatic polyester such as "Valox" or the like.

The filler used between the conductors in the cable may be any suitable material or non-conductive material such as waxed twine, synthetic filaments, jute, paper, asbestos or other suitable filler material.

The various conductors may be cabled together at a lay of from about 3 to about 6 inches but a lay of about 4 inches is preferred. The lay of the strands of wire and of the cabled wires are preferably in the same direction. A left hand lay is preferred for the stranded wires, the cabling and the retractable helical coils.

The flexible film overwrap on the cable conductors should be sufficiently strong to prevent the wires from unwinding and prevent adherence to the underlying conductor members as a sheath is extruded thereover. A poly(ethylene) terephthalate film such as "Mylar" film about 1.5 mils thick and about 2 inches wide may be used for this purpose. A tape or film of this kind should be spirally wound about the cabled wires with about a 25percent overlap at its edges. Other materials may be substituted for the "Mylar" film such as, for example, metal films, aluminum "Mylar" is a poly(ethylene) terephthalate film sold by E.I. duPont de Nemours & Co. The plastic film insulates the conductors against damage from heat during the extrusion of the sheath. It is not required for all embodiments of the invention.

The sheath may be extruded from any suitable synthetic resinous material of the kind specified above for the primary insulation or other synthetic resin such as nylon, polyvinyl chloride, polyethylene, polypropylene or the like which has a crystallinity and can be coiled into a retractable or self-storing form which is easily extendable. A preferred material for the sheath is a blend of about 60 parts by weight of "Hytrel" co-segmented polyester having a hardness of Shore D 55 and 40 parts of "Hytrel" co-segmented polyester having a hardness of about Shore A 90. The crystallinity of the sheath increases as the amount of "Hytrel" Shore D 55 is increased. The amount of the two "Hytrels" in the blend may be varied from about 95 to 5 to about 5 to 95 of Shore D 55 to Shore A 90.

Figure 2:
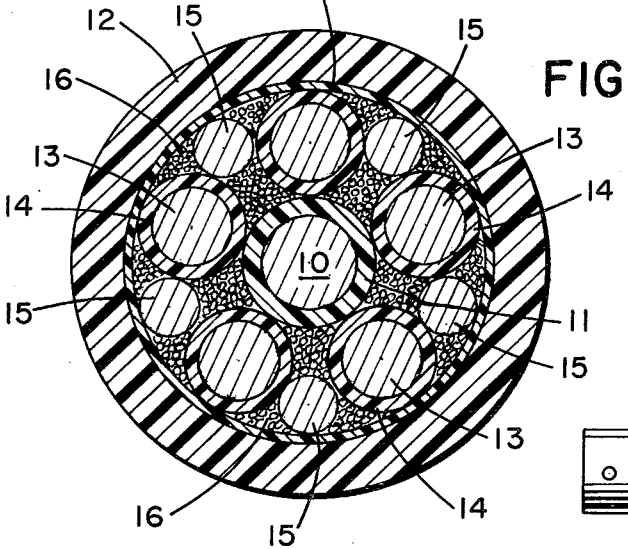
FIG. 2 is a section taken along the line 2—2 of FIG. 1.
Figure 3:
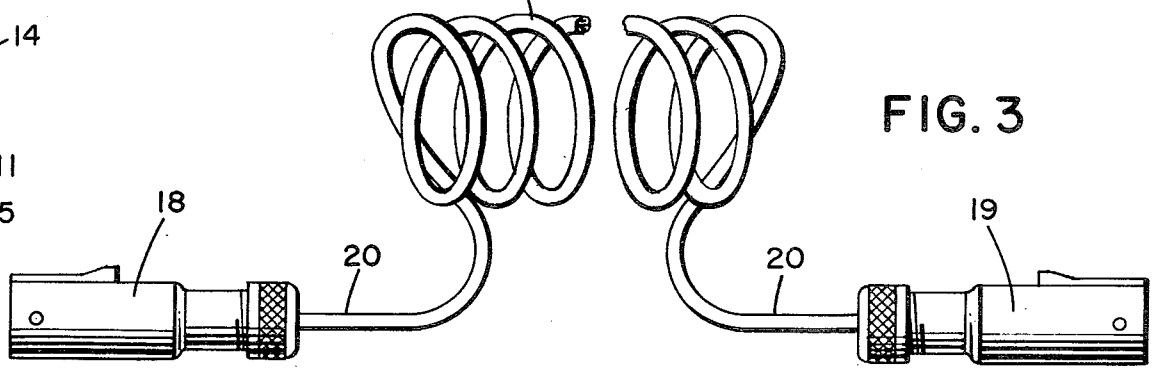
FIG. 3 is a side elevation illustrating a cable in a retractable form.

Referring now to the drawing, FIGS. 1 through 3 illustrate one embodiment of the invention. A 10 gauge stranded wire 10 having primary insulation 11 of extruded "Hytrel" co-segmented polyester having a hardness of Shore D 55 extends co-axially through extruded polymeric sheath 12. Sheath 12 is a blend of 60 percent "Hytrel" co-segmented polyester having a Shore D 55 hardness and 40 percent "Hytrel" co-segmented polyester having a hardness of Shore A 90. Five 12 gauge stranded wires 13 having insulation 14 of the same composition as that of insulation 11 are evenly circumferentially spaced about the periphery of wire 10 and within sheath 12. Five uninsulated 14 gauge stranded wires 15 are disposed between the peripheries of wires 13. A suitable cotton twine filler 16 fills the spaces between the wires 10, 13 and 15. A "Mylar" film 17 about 1.5 mils thick is helically wound about the assembly of wires with an overlap at its edges of about 25 percent.

The cabling of the stranded wires and of the plurality of wires making up the cable should be in the same direction, preferably with a left hand lay. The cabling of the conductors is preferably at a lay of about 4 inches.

As illustrated in FIG. 3, the cable may be formed in a retractable helical coil having preferably a left hand lay, with plugs 18 and 19 on the ends thereof. The end of the cable may be provided with a pigtail 20, as illustrated in FIG. 3 or other configurations such as a straight segment. Coiling of the cable may be achieved by winding the cable at the desired lay about a suitable mandrel, heating the cable to a temperature between its softening point and melting point and quenching it to set it in the coil form. With a sheath of a blend of 60 percent "Hytrel" Shore D 55 and 40 percent Shore A 90, the coiled cable is preferably heated for about 30 to 40 minutes at from 275° to 325° F. and then quenched in cold water. The mandrel may be, for example, about 2⅜ inches in diameter.

"Valox" is an aromatic polyester sold by General Electric Company and is basically a polyester of terrephthalic acid and ethylene glycol. "Hytrel" is a co-segmented thermoplastic polyester of poly (tetramethylene ether) glycol and 1,4-butane diester terephthalic acid and isophthalic acid of the kind disclosed in U.S. Pat. No. 3,766,146. "Hytrel" is sold by E. I. duPont de Nemours & Co.

Although the invention has been described in detail for the purposes of illustration, it is to be understood that such detail is solely for that purpose and that variations can be made therein by those skilled in the art without departing from the spirit and scope of the invention except as it may be limited by the claims.

What is claimed is:

1. An electrical cable comprising a polymeric sheath, a first insulated stranded wire conductor disposed in the sheath and substantially co-axial therewith, four to six insulated stranded conductors of smaller gauge than the first conductor disposed about the periphery of the first conductor, uninsulated stranded conductors of smaller gauge than the said smaller insulated conductors, and an electrically insulating filler material disposed in the spaces between the said conductors combining to form a cable which is substantially circular in cross-section tightly enclosed in said sheath.

2. The electrical cable of claim 1 wherein a flexible film is helically wound with overlapping edges about the said conductors and filler.

3. The electrical cable of claim 1 wherein the insulation on the stranded conductors and the sheath are a thermoplastic segmented co-polyester.

4. The electrical cable of claim 1 wherein the sheath is a blend of segmented co-polyester having a hardness of Shore D 55 and a co-segmented polyester having a hardness of Shore A 90.

5. The electrical cable of claim 1 wherein the primary insulation on the conductors is a segmented copolyester having a hardness of D 55 and the sheath is a blend of a segmented co-polyester having a hardness of Shore D 55 and a segmented co-polyester having a Shore hardness of A 90.

6. The cable of claim 1 wherein the said co-axial conductor is about 10 gauge, five smaller insulated conductors of about 12 gauge are disposed about the co-axial conductor and five uninsulated conductors of 14 gauge are disposed in the spaces between the smaller insulated conductors.

7. The cable of claim 1 wherein the uninsulated stranded conductors are grouped together at the end of the cable to form a common conductor.

8. The cable of claim 1 wherein the flexible film is polyethylene terephtalate ester.

9. The cable of claim 1 coiled in a retractable configuration.

10. The cable of claim 1 wherein the strands of all of the conductors are helically wound in the same direction and the smaller insulated conductors and the uninsulated conductors are helically wound about the first conductor in the same direction as the stranded wires.

* * * * *